US010859079B2

(12) United States Patent
Zhang et al.

(10) Patent No.: US 10,859,079 B2
(45) Date of Patent: Dec. 8, 2020

(54) SYSTEM FOR MOUNTING A REFRIGERANT COMPRESSOR HOUSING TO A BASE PLATE

(71) Applicant: NIDEC COMPRESSORS (TIANJIN) CO., LTD., Tianjin (CN)

(72) Inventors: Jingfei Zhang, Tianjin (CN); Bin Liu, Tianjin (CN)

(73) Assignee: NIDEC COMPRESSORS (TIANJIN) CO., LTD., Tianjin (CN)

( * ) Notice: Subject to any disclaimer, the term of this patent is extended or adjusted under 35 U.S.C. 154(b) by 75 days.

(21) Appl. No.: 16/302,507

(22) PCT Filed: May 15, 2017

(86) PCT No.: PCT/CN2017/084320
§ 371 (c)(1),
(2) Date: Nov. 16, 2018

(87) PCT Pub. No.: WO2017/198123
PCT Pub. Date: Nov. 23, 2017

(65) Prior Publication Data

US 2019/0170132 A1 Jun. 6, 2019

(30) Foreign Application Priority Data

May 18, 2016 (CN) ..... 2016 2 0455294 U

(51) Int. Cl.
*F04B 39/00* (2006.01)
*F04B 39/12* (2006.01)
*F04B 39/14* (2006.01)

(52) U.S. Cl.
CPC ..... *F04B 39/121* (2013.01); *F04B 39/00* (2013.01); *F04B 39/14* (2013.01); *F04B 39/0027* (2013.01)

(58) Field of Classification Search
CPC ..... F04B 39/121; F04B 39/0044
See application file for complete search history.

(56) References Cited

U.S. PATENT DOCUMENTS 6,088,896 A * 7/2000 Tang ..... B25B 27/28 269/3
6,354,558 B1 * 3/2002 Li ..... F16F 1/3732 248/615

(Continued)

FOREIGN PATENT DOCUMENTS

CN 102947656 A 2/2013
CN 203570527 U 4/2014

(Continued)

OTHER PUBLICATIONS

ESPACENET English Abstract of CN205689383, Nov. 16, 2016 (1 page) and ESPACENET machine (English) translation of published CN205689383, having a filing date of May 18, 2016.

(Continued)

*Primary Examiner* — Bradley Duckworth
(74) *Attorney, Agent, or Firm* — McKee, Voorhees & Sease, PLC

(57) ABSTRACT

A system for mounting a refrigerant compressor housing (11) to a base plate (9) having threaded holes (10), the system comprising at least two screw pins (1) and one clip (2) for connecting the two screw pins, each screw pin (1) has a threaded portion (3), a middle portion (4) to be inserted into a respective opening (17) of the refrigerant compressor housing (11), a neck portion (5) having a smaller diameter than the middle portion (4) and a head portion (6) having a larger diameter than the neck portion (5). The elongate clip (2) has one slot (7, 8) respectively in each of its two end portions, the first slot (7) having a width equal to the diameter of the neck portion (5) of the screw pin (1) and being oriented in longitudinal direction of the clip (2), the second slot (8) narrowing to a width smaller than the diameter of the neck portion (5) of the screw pin (1) and then enlarging to a diameter equal to the diameter of the neck portion (5) and the second slot (8) being oriented normal to (Continued)

the longitudinal direction of the clip (2). This system has the advantages of convenient installation and stable fixation.

9 Claims, 4 Drawing Sheets

(56) References Cited

U.S. PATENT DOCUMENTS

| | | | | |
|---|---|---|---|---|
| 7,814,760 | B2 * | 10/2010 | Immel | F04B 39/0044 415/140 |
| 10,359,225 | B2 * | 7/2019 | Lesko | F25B 31/00 |
| 2007/0235624 | A1 * | 10/2007 | Lee | F04B 39/0044 248/674 |
| 2009/0272872 | A1 * | 11/2009 | Hoffman | F16F 1/3732 248/673 |
| 2010/0018245 | A1 * | 1/2010 | Madsen | F04B 39/121 62/508 |
| 2017/0059231 | A1 * | 3/2017 | Kerner | F25D 23/006 |
| 2019/0120221 | A1 * | 4/2019 | Kim | F04B 39/121 |
| 2019/0285333 | A1 * | 9/2019 | Lesko | F04B 39/0044 |

FOREIGN PATENT DOCUMENTS

| | | | |
|---|---|---|---|
| CN | 204774499 | U | 11/2015 |
| CN | 205689383 | U | 11/2016 |
| DE | 102010002045 | A1 | 8/2011 |
| EP | 1002968 | B1 | 5/2000 |
| JP | 201324069 | A | 2/2013 |

OTHER PUBLICATIONS

ESPACENET English Abstract of CN102947656, Feb. 27, 2013 (1 page) and ESPACENET machine (English) translation of published CN102947656, having a filing date of Feb. 1, 2011.

ESPACENET English Abstract of CN204774499, Nov. 18, 2015 (1 page) and ESPACENET machine (English) translation of published CN20474499, having a filing date of Jun. 8, 2015.

ESPACENET English Abstract of CN203570527, Apr. 30, 2014 (1 page) and ESPACENET machine (English) translation of published CN203570527, having a filing date of Nov. 1, 2013.

ESPACENET English Abstract of JP2013024069, Feb. 4, 2013 (1 page) and ESPACENET machine (English) translation of published JP2013024069, having a filing date of Jul. 19, 2011.

ESPACENET English Abstract of DE102010002045, Aug. 18, 2011 (1 page) and ESPACENET machine (English) translation of published DE102010002045, having a filing date of Feb. 17, 2010

State Intellectual Property Office of the P.R.China, "International Search Report" in connection with PCT/CN2017/084320 filed May 15, 2017, dated Aug. 21, 2017.

State Intellectual Property Office of the P.R.China, "Written Opinion of the International Searching Authority", in connection to PCT/CN2017/084320, filed May 15, 2017, dated Aug. 21, 2017.

* cited by examiner

SYSTEM FOR MOUNTING A REFRIGERANT COMPRESSOR HOUSING TO A BASE PLATE

CROSS-REFERENCE TO RELATED APPLICATION

This application claims benefit under 35 U.S.C. § 119 or § 120 to China application Serial No. 201620455294.1 filed May 18, 2016, herein incorporated by reference in its entirety.

FIELD OF THE INVENTION

The present invention relates to a system for mounting a refrigerant compressor housing to a base plate having threaded holes, the system comprising at least two screw pins and one clip to connect the two screw pins.

The system according to the invention can be used for refrigerant compressors which are situated in a compressor housing, e.g. consisting of two parts, namely a compressor housing base and a compressor housing cover. Such a compressor housing hermetically encloses a cylinder housing and a drive assembly, the refrigerant compressor further comprising a cylinder and a piston which are arranged inside the cylinder housing, said piston being drivable by the drive assembly, in order to move back and forth in the cylinder for compressing a refrigerant.

BACKGROUND OF THE INVENTION

For mounting a compressor housing in a refrigerator, the compressor housing often first has to be fixed to a base plate. Normally the compressor housing has some kind of legs with openings in the legs for that purpose. There are several methods to quickly and simply mount the compressor housing to the base plate. One method is to use screws with heads larger than the openings of the legs of the compressor housing and to simply screw the legs to the base plate which has corresponding threaded holes.

Another possibility is to use bolts which press the legs to one side of the base plate and which bolts are secured on the other side of the base plate by using clips. Such clips are only snapped on the bolts which is faster than screwing screws into the base plate. However, during production access to both sides of the base plate is necessary.

OBJECTIVE OF THE INVENTION

It is thus an objective of the present invention to provide a system for mounting a refrigerant compressor housing to a base plate which base plate already has threaded holes in it but which system does not need access to both sides of the base plate.

SUMMARY OF THE INVENTION

According to the invention a system for mounting a refrigerant compressor housing to a base plate having threaded holes is provided, the system comprising at least two screw pins and one clip to connect the two screw pins, whereas each screw pin, as seen in its longitudinal direction, has a threaded portion for screwing the screw pin into a threaded hole of a base plate, the threaded portion being followed by a middle portion to be inserted into a respective opening of a refrigerant compressor housing, the middle portion being followed by a neck portion having a smaller diameter than the middle portion, the neck portion being followed by a head portion, the head portion having a larger diameter than the neck portion, the system being further characterized in that the elongate clip has one slot in each of its two end portions, the first slot having a width equal to the diameter of the neck portion of the screw pin and being oriented in longitudinal direction of the clip, the second slot narrowing to a width smaller than the diameter of the neck portion of the screw pin and then enlarging to a diameter equal to the diameter of the neck portion and the second slot being oriented normal to the longitudinal direction of the clip.

Using this system one can screw two screw pins into the base plate from the top side of the base plate, each screw pin into one threaded hole. Then the compressor housing is put onto the base plate from the top side of the base plate so that the screw pins protrude through the openings of the legs of the compressor housing. Then—again working on the top side of the base plate—the neck of the first screw pin is inserted into the first slot of the clip. The clip is turned around the neck of the first screw pin—in a plane parallel to the base plate—so that the neck of the second screw pin is inserted into the second slot of the clip and by pressing the clip further against the neck of the second screw pin the neck passes the narrowing portion of the second slot and is securely fixed in the second slot. As a result the legs of the compressor housing are held in place, that is, they are pressed against the base plate by the clip.

In order to secure the clip against lateral displacement, that is displacement parallel to the base plate when mounted on the base plate, in a preferred embodiment of the present invention, it is provided that the enlarging portion of the second slot is again followed by a second narrowing portion which portions correspond to the outer dimensions of the neck portion of the screw pin in order to hold the neck portion within the enlarging portion and the second narrowing portion of the second slot.

A preferred embodiment of the invention provides that the clip is made of sheet metal. Thus the clip or clips can be produced easily and nevertheless have the necessary stability.

In order to provide a grip for manually mounting the clip, it is provided in a preferred embodiment of the present invention that around the second slot the clip has at least one flap which is formed from the sheet metal of the clip folding the sheet metal normal to the plane of the clip.

In this case a first flap can be oriented parallel to the second slot. A second flap can be oriented normal to the second slot and facing away from the entrance of the second slot.

In a preferred embodiment of the present invention it is provided that the system comprises four screw pins and two clips and that the first clip is the mirror image of the second clip. Thus it is possible to mount one clip from the left of the compressor housing and one clip from the right of the compressor housing.

In a preferred embodiment of the present invention it is provided that the head portion of the screw pin has indentations or lobes in order to allow the screw pin to be screwed in by hand or with a tool.

Once the system is mounted the system in a preferred embodiment further comprises a refrigerant compressor housing and a base plate having four threaded holes, four screw pins being screwed into the base plate, the middle portion of each screw pin being in a respective opening of a leg of the refrigerant compressor housing, the leg of the refrigerant compressor housing contacting the base plate, the first clip having its first slot around the neck portion of a first screw pin and the second slot around the neck portion of a second screw pin, the second clip having its first slot around the neck portion of a third screw pin and the second slot around the neck portion of a fourth screw pin.

BRIEF DESCRIPTION OF FIGURES

The invention will be explained in closer detail by reference to a preferred embodiment, with FIG. 1 showing a schematic side view of a screw pin according to the present invention FIG. 2 showing a schematic top view of a clip according to the present invention, FIG. 3 showing a schematic three-dimensional view of a base plate for a refrigerant compressor with screw pins to be installed, FIG. 4 showing a schematic three-dimensional view of the base plate of FIG. 3 with a refrigerant compressor housing to be installed, FIG. 5 showing a schematic three-dimensional view of one leg of the refrigerant compressor housing of FIG. 4 mounted on the base plate and a clip to be inserted, FIG. 6 showing the leg of FIG. 5 with the clip inserted into one screw pin, FIG. 7 showing the leg of FIGS. 5 and 6 with the clip inserted into both screw pins.

DETAILED DESCRIPTION OF EXEMPLARY EMBODIMENTS OF THE INVENTION

Figure 1:
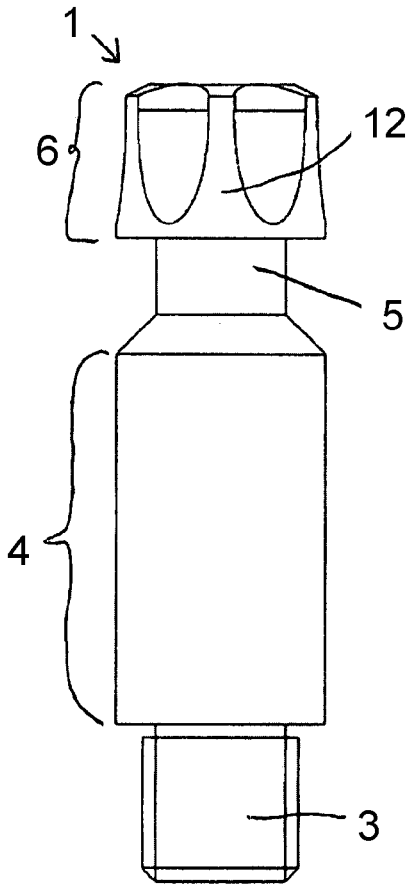

FIG. 1 shows a screw pin 1 according to the present invention. When seen in its longitudinal direction, that is from bottom to top in FIG. 1, the screw pin 1 has at its bottom a threaded portion 3 for screwing the screw pin into a threaded hole 10 (see FIG. 3) of a base plate 9 (see FIG. 3). The threaded portion 3 is followed by a middle portion 4 which can be inserted into a respective opening of a refrigerant compressor housing 11 (see FIG. 4). The middle portion 4 here has cylindrical form and has a larger diameter than the threaded portion 3. The middle portion 4 is followed by a neck portion 5 having a smaller diameter than the middle portion 4. The neck portion 4 here also has cylindrical form. The neck portion 5 connects to the middle portion 4 via a tapered portion. The neck portion 5 is followed by a head portion 6, which again has a larger diameter than the neck portion 5. The head portion 6 of the screw pin 1 here has lobes 12 in order to allow the screw pin 1 to be screwed in by hand or with a tool.

The screw pin 1 is made of metal.

Figure 2:
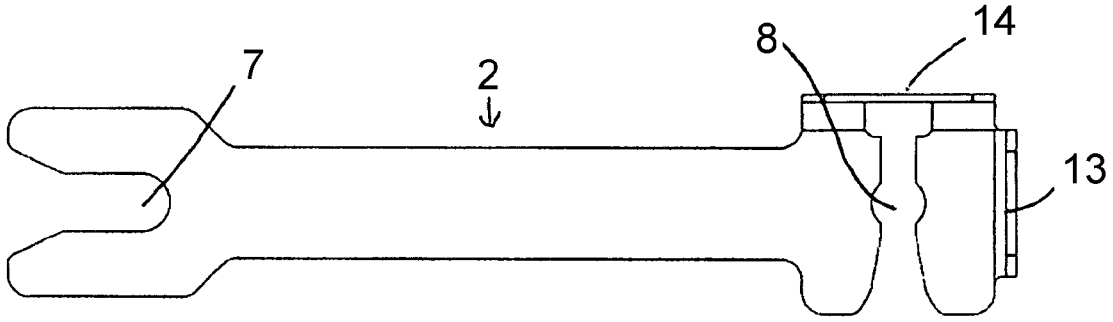

FIG. 2 shows a schematic top view of a clip 2 according to the present invention. The clip 2 is elongate and has one slot 7,8 in each of its two end portions. The first slot 7 has a width equal to the diameter of the neck portion 5 of the screw pin 1 and is oriented in longitudinal direction of the clip 2, that is from left to right in FIG. 2. The second slot 8 has its entrance on the bottom of FIG. 2. The second slot 8 narrows from its entrance to a width smaller than the diameter of the neck portion 5 of the screw pin 1 and then enlarges to a diameter equal to the diameter of the neck portion 5. This enlarging portion of the second slot 8 is again followed by a second narrowing portion. The enlarging port ion and the second narrowing portion correspond to the outer dimensions of the neck portion 5 of the screw pin 1 in order to hold the neck portion 5 within the enlarging portion and the second narrowing portion of the second slot 8. The enlarging portion and the second narrowing portion here have the form of a circular arc. The circular arcs correspond to the neck portion 5 which has cylindrical form.

The second slot 8 is oriented normal the longitudinal direction of the clip 2, that is from bottom to top in the drawing of FIG. 2.

The clip 2 is made of sheet metal.

In order to provide a grip for manually mounting the clip 2 the clip 2 has two flaps 13, 14 around the second slot 8 which are formed from the sheet metal of the clip 2 by folding the sheet metal normal to the plane of the clip 2. The first flap 13 is oriented parallel to the second slot 8. The second flap is oriented normal to the second slot 8 and facing away from the entrance of the second slot 8.

Figure 3:
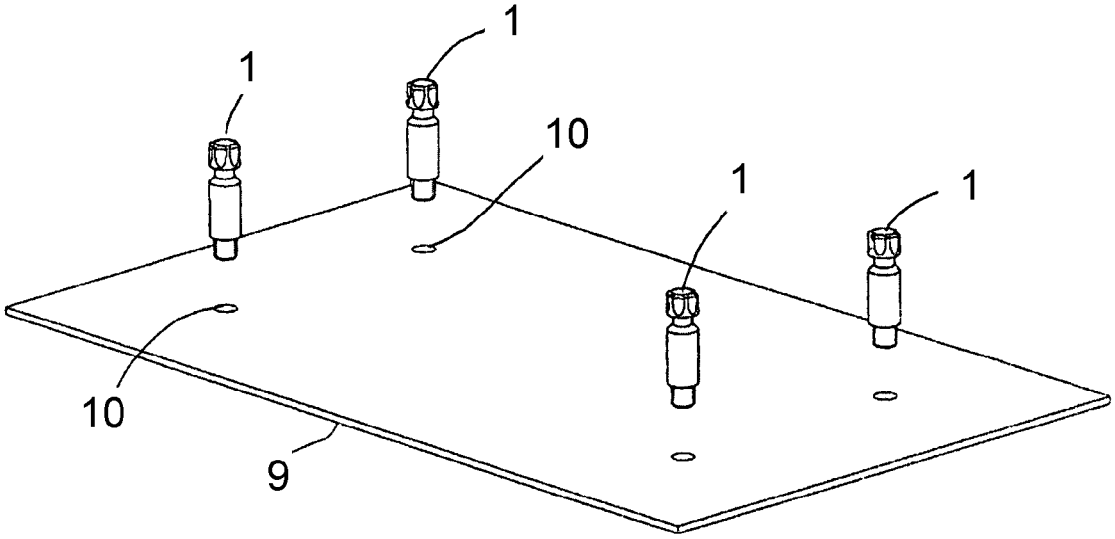

FIG. 3 shows a schematic three-dimensional view of a base plate 9 for a refrigerant compressor with four screw pins 1 to be installed, see the arrows below the screw pins 1. The base plate 9 has four threaded holes 10 and the four screw pins 1 will be screwed into the base plate with their respective threaded portions 3. The middle portions 4, the neck portions 5 and the head portions 6 of the screw pins 1 protrude from the top of the base plate 9.

Figure 4:
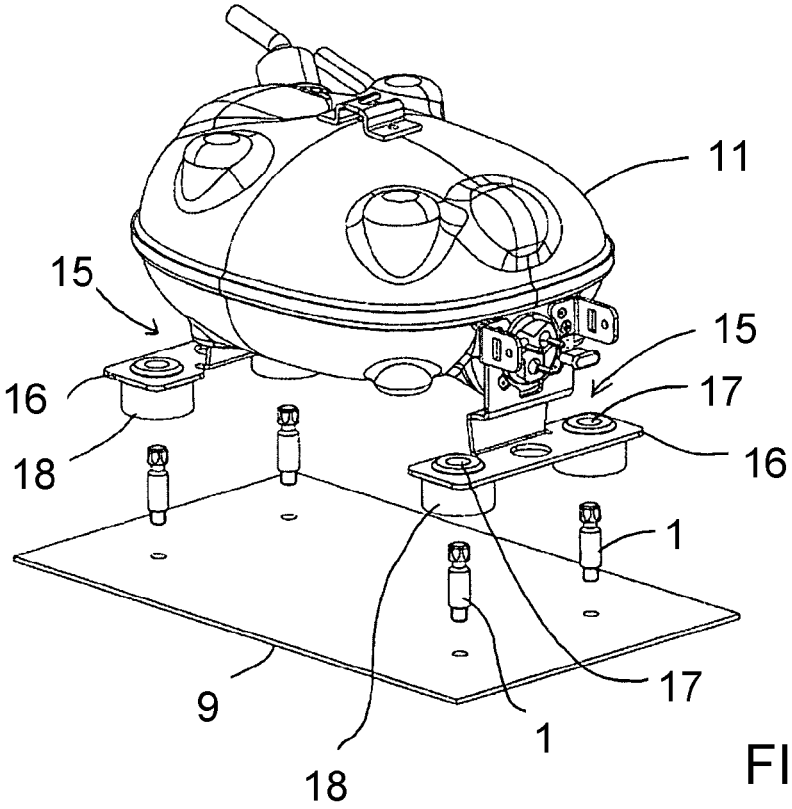

This can be seen in FIG. 4, where a refrigerant compressor housing 11 to be installed is depicted above the base plate 9. The refrigerant compressor housing has two legs 15. Each leg 15 has a plate 16, which plates 16 here are oriented parallel to the base plate 9. Each plate 16 has two circular openings 17. Each opening 17 is surrounded by a cylindrical sleeve 18, here in the form of a rubber grommet, which in mounting position is situated below the plate 16. The height of the sleeve 18 and the thickness of the plate 16 together correspond to the height of the middle portion 4 of the screw pin 1. Thus only the neck portion 5 and the head portion 6 of the screw pins 1 protrude out of the leg 15 once the housing 11 is mounted on the base plate 9, that is, once the sleeves 18 are put around the screw pins 1 and contact and stand on the base plate 9. The inner diameter of the sleeves 18 is dimensioned according to the diameter of the middle portions 4 of the screw pins 1 so that the housing 11 is secured against lateral movement (=parallel to the base plate 9) by the screw pins 1.

Figure 5:
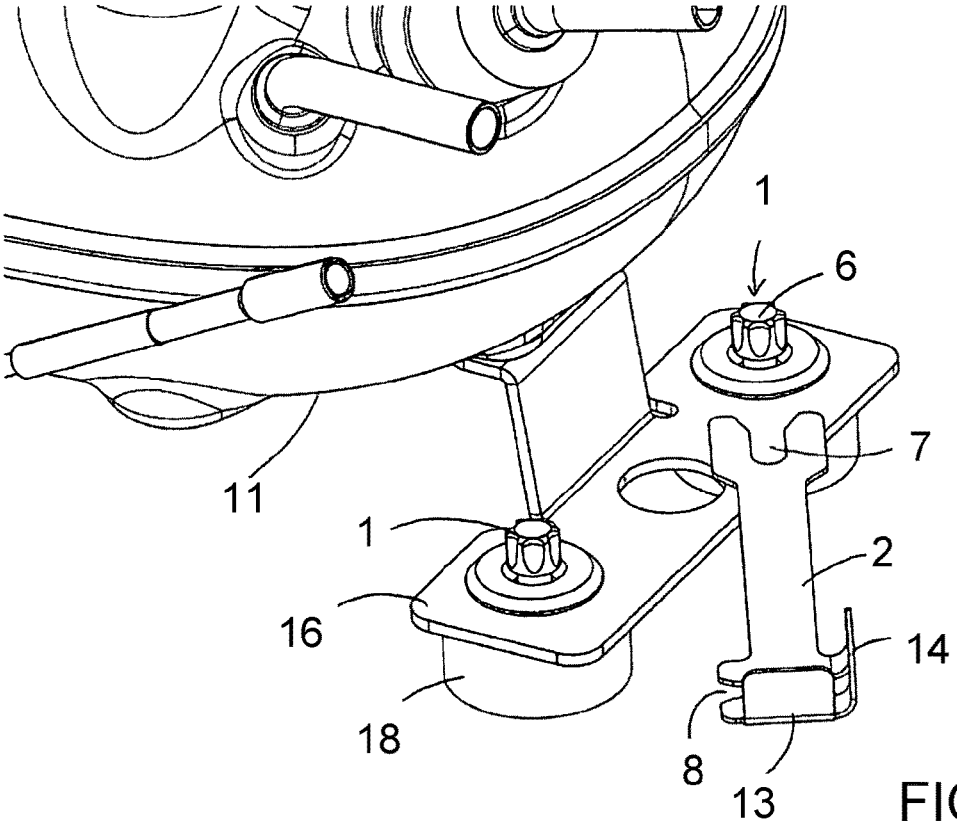

Next the clip 2 of FIG. 2 is inserted with its first slot 7 into the neck portion 5 of a first screw pin, namely the one near the top right corner of the base plate 9 in FIG. 4. This is depicted in FIG. 5.

Figure 6:
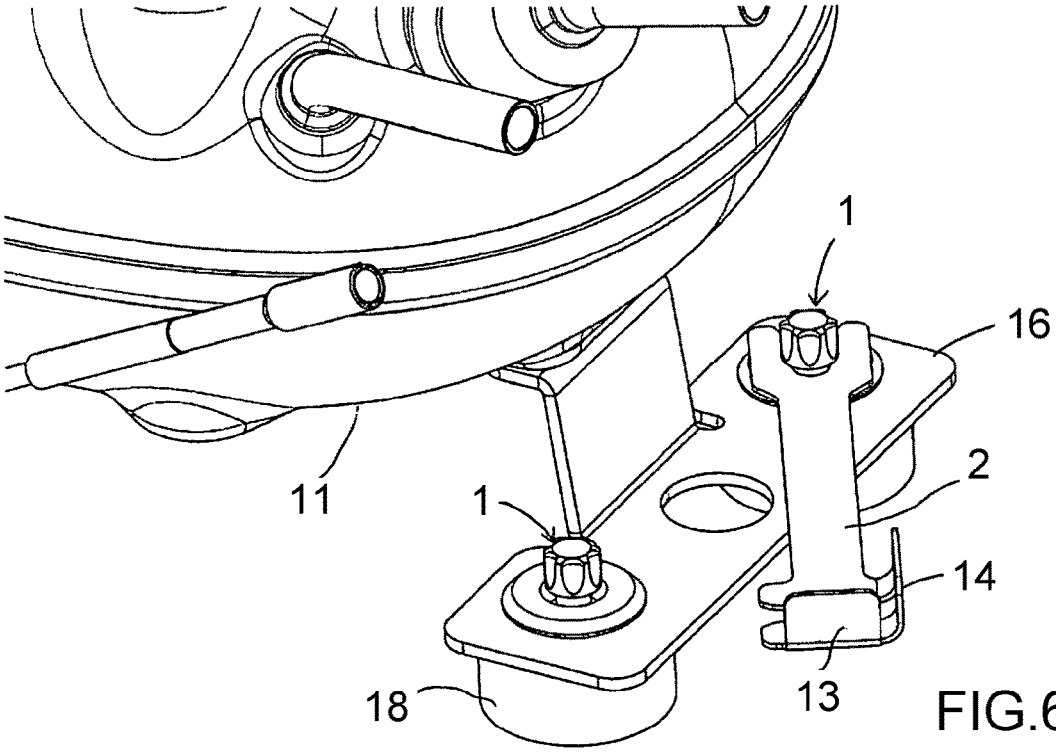

In FIG. 6 one can see that the first slot 7 of clip 2 is inserted or put around the neck portion 5 of the first screw pin 1 until the end of the first slot 7. Then the clip 2 is rotated around the first screw pin 1 so that the second slot 8 reaches the second screw pin 1, the one in the bottom right corner of FIG. 4. The distance between the end of the first slot 7 and the second slot 8 equals the distance of the two screw pins 1 in FIG. 5-7.

The flaps 13,14 are used as grip or handles to move the clip 2. First flap 13 is used to press the first slot 7 of the clip 2 around the first screw pin 1, see FIG. 5. The second flap 14 is used to to press, the second slot 8 of the clip 2 around the second screw pin 1, see FIG. 6.

Figure 7:
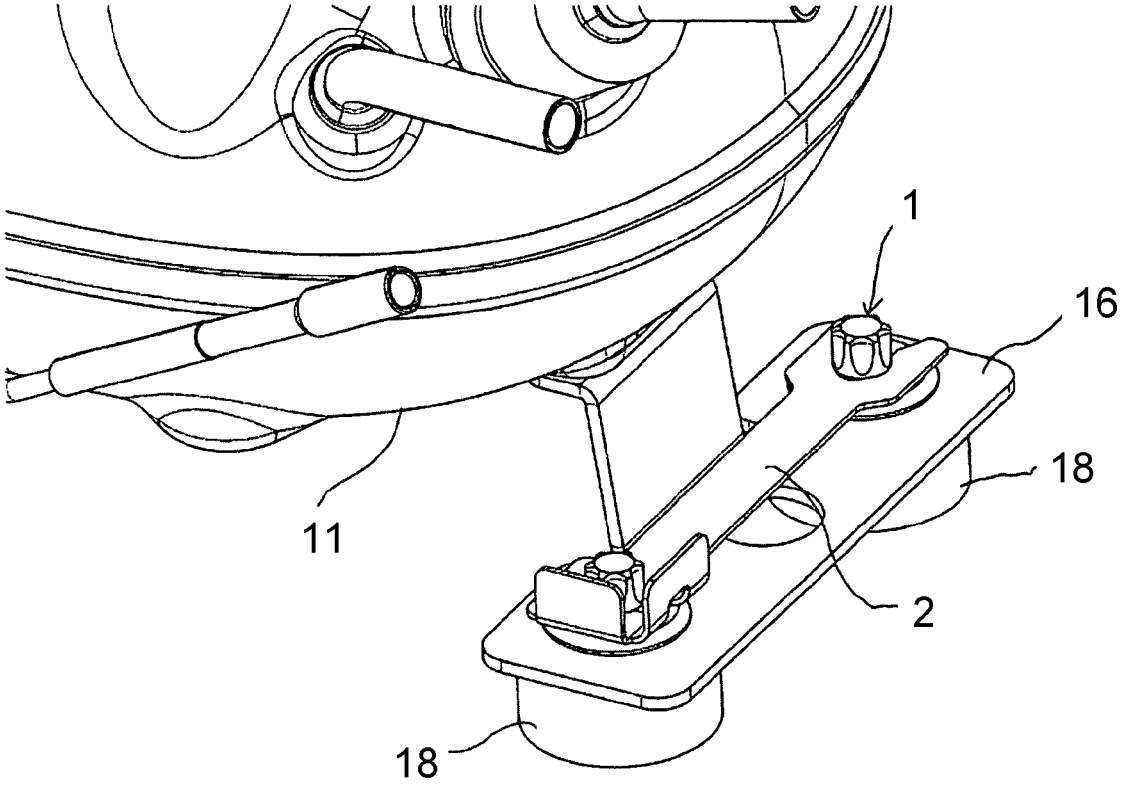

In FIG. 7, the clip 2 has its first slot 7 around the neck portion 5 of the first screw pin 1 and the second slot 8 around the neck portion 5 of the second screw pin 1. That means that the neck portion 5 of the bottom screw pin 1 in FIG. 7 is within the circular arcs of the second slot 8 of clip 2, thus the clip 2 is locked and the housing 11 is pressed against the base plate 9.

In order to mount also the left leg 15 of the housing 11 in FIG. 4, one needs a second clip which is not identical to the clip 2 in FIG. 2 but which is its mirror image. This second clip can be constructed by a mirror plane which is normal to the plane of projection of FIG. 2 and which runs from left to right in FIG. 2. So the second clip has the entrance of the second slot 8 at the top (and not at the bottom as clip 2 in FIG. 2).

This second clip can be inserted with its first slot 7 around the neck portion 5 of top left screw pin 1 in FIG. 4, then the second clip can be turned right and the second slot 8 will be pressed around the neck portion 5 of bottom left screw pin 1 in FIG. 4 from the left so that the neck portion 5 of the bottom left screw pin 1 of FIG. 4 is within the circular arcs of the second slot 8 of the second clip.

With the present invention it is possible to us a snap on mounting technique also for base plates 9 with screw holes. Although snap on clips for single pins are known, these clips for single pins have to be mounted on the back side of the base plate 9 which includes one more mounting step for turning around the base plate 9. And more space on the back side of the base plate 9 is needed which consumes valuable space or a refrigerator.

With the present invention it is possible to work only on the top side of the base plate 9 when mounting the housing 11. No space on the back side of the base plate 9 is wasted. The clip and the second clip can be mounted manually at the same time, the clip 2 from the right (e.g. with the right hand), as depicted in FIGS. 5-7, and the second clip from the left (e.g. with the left hand), with reference to FIG. 4. Thus operation time for mounting and work load can be reduced.

No tools are needed to snap the clips 2 into the locking position. So even if the housing 11 is very large and/or other objects like controller boxes or tubes relating to the compressor are around the housing 11, it is normally possible to insert the clip 2 with its first slot 7 into the screw pins 1 at the top of the base plate 9, assuming that the assembler sits in front of the base plate 9 as in FIG. 4.

LIST OF REFERENCE SIGNS

1 screw pin
2 clip
3 threaded portion
4 middle portion
5 neck portion
6 head portion
7 first slot
8 second slot
9 base plate
10 threaded hole
11 refrigerant compressor housing
12 lobe
13 first flap
14 second flap
15 leg
16 plate
17 opening of plate 16
18 sleeve (grommet)

The invention claimed is:

1. A system for mounting a refrigerant compressor housing to a base plate having threaded holes, the system comprising at least two screw pins and one clip to connect the two screw pins, comprising: each screw pin, as seen in its longitudinal direction, has a threaded portion for screwing the screw pin into the threaded hole of the base plate, the threaded portion being followed by a middle portion to be inserted into a respective opening of the refrigerant compressor housing, the middle portion being followed by a neck portion having a smaller diameter than the middle portion, the neck portion being followed by a head portion, the head portion having a larger diameter than the neck portion, further comprising the clip has one slot in each of its two end portions, the first slot having a width equal to the diameter of the neck portion of the screw pin and being oriented in longitudinal direction of the clip, the second slot narrowing to a width smaller than the diameter of the neck portion of the screw pin and then enlarging to a diameter equal to the diameter of the neck portion and the second slot being oriented normal to the longitudinal direction of the clip.

2. The system according to claim 1, wherein the enlarging portion of the second slot is again followed by a second narrowing portion which said narrowing and said second narrowing portions correspond to the outer dimensions of the neck portion of the screw pin in order to hold the neck portion within the enlarging portion and the second narrowing portion of the second slot.

3. The system according to claim 1, wherein the clip is made of sheet metal.

4. The system according to claim 3, wherein around the second slot the clip has at least one flap which is formed from the sheet metal of the clip by folding the sheet metal normal to the plane of the clip.

5. The system according to claim 4, wherein a first flap is oriented parallel to the second slot.

6. The system according to claim 5, wherein a second flap is oriented normal to the second slot and facing away from the entrance of the second slot.

7. The system according to claim 1, wherein the at least two screw pins and one clip comprises four screw pins and two clips and that the first clip is the mirror image of the second clip.

8. The system according to claim 1, wherein the head portion of the screw pin has indentations or lobes in order to allow the screw pin to be screwed in by hand or with a tool.

9. The system according to claim 1, wherein the system further comprises the refrigerant compressor housing having four legs and the base plate having four said threaded holes, four said screw pins being screwed into the base plate, the middle portion of each said screw pin being in a respective opening of a said leg of the refrigerant compressor housing, the leg of the refrigerant compressor housing contacting the base plate, the at least one clip comprising two clips wherein the first clip having its first slot around the neck portion of a first screw pin and the second slot around the neck portion of a second screw pin, the second clip having its first slot around the neck portion of a third screw pin and the second slot around the neck portion of a fourth screw pin.

* * * * *